US006750182B1

(12) United States Patent
Nadasdi

(10) Patent No.: US 6,750,182 B1
(45) Date of Patent: Jun. 15, 2004

(54) POLAR OIL BASED INDUSTRIAL OILS WITH ENHANCED SLUDGE PERFORMANCE

(75) Inventor: Todd Timothy Nadasdi, Kingsville (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/169,649

(22) Filed: Oct. 9, 1998

(51) Int. Cl.[7] ..... C10M 105/38

(52) U.S. Cl. ..... 508/304; 508/485; 508/550; 252/77; 252/79

(58) Field of Search ..... 508/304, 485, 508/550; 252/77, 79

(56) References Cited

U.S. PATENT DOCUMENTS

| | | | | | |
|---|---|---|---|---|---|
| 3,346,496 | A | | 10/1967 | Neumann et al. | 252/50 |
| 4,105,571 | A | * | 8/1978 | Shaub et al. | 508/237 |
| 4,125,472 | A | * | 11/1978 | Braid | 508/286 |
| 4,158,633 | A | * | 6/1979 | Papay | 508/372 |
| 4,175,046 | A | * | 11/1979 | Coant et al. | 508/485 |
| 4,178,258 | A | * | 12/1979 | Papay et al. | 508/363 |
| 4,228,020 | A | * | 10/1980 | Papay | 508/128 |
| 4,293,432 | A | * | 10/1981 | Papay et al. | 508/438 |
| 4,497,721 | A | * | 2/1985 | Katayama | 570/304 |
| 4,519,932 | A | | 5/1985 | Schnur et al. | 252/73 |
| 4,612,054 | A | * | 9/1986 | Hamon | 106/264 |
| 4,826,633 | A | | 5/1989 | Carr et al. | 252/56 S |
| 5,085,788 | A | * | 2/1992 | Emert et al. | 508/291 |
| 5,156,768 | A | | 10/1992 | Thomas et al. | 252/384 |
| 5,219,479 | A | * | 6/1993 | Mathiesen et al. | 508/485 |
| 5,232,614 | A | * | 8/1993 | Colclough et al. | 508/375 |
| 5,372,737 | A | | 12/1994 | Spauschus | 252/68 |
| 5,498,356 | A | | 3/1996 | Kamakura et al. | 252/50 |
| 5,553,465 | A | | 9/1996 | Fukuda et al. | 62/468 |
| 5,614,483 | A | | 3/1997 | Fessenbecker et al. | 508/550 |
| 5,658,863 | A | * | 8/1997 | Duncan | 508/485 |
| 5,681,800 | A | * | 10/1997 | Duncan | 508/485 |
| 5,750,046 | A | | 5/1998 | Wheeler | 252/68 |
| 5,806,336 | A | * | 9/1998 | Sunaga | 252/58 |

FOREIGN PATENT DOCUMENTS

| | | | |
|---|---|---|---|
| EP | 0518567 | 12/1992 | C10M/105/38 |
| EP | 0647701 | 4/1995 | C10M/133/22 |
| EP | 0715079 | 6/1996 | F04C/18/356 |
| GB | 2063909 | 6/1981 | C10M/3/28 |
| JP | 09125086 | 5/1913 | C10M/169/04 |
| JP | 08120288 | 5/1914 | C10M/133/22 |
| JP | 09188891 | 7/1922 | C10M/169/04 |
| JP | 09189453 | 7/1922 | C10M/169/04 |
| JP | 07224000 | 8/1922 | C07C/67/62 |
| JP | 07133487 | 5/1923 | C10M/133/22 |

OTHER PUBLICATIONS

Smalheer, C.V., Lubricant Additives, 1967, The Lezius–Hiles Co., p. 1, col. 2.*

* cited by examiner

*Primary Examiner*—Margaret Medley
(74) *Attorney, Agent, or Firm*—Joseph J. Allocca; Estelle C. Bakun

(57) ABSTRACT

Ester based industrial oils containing acid scavengers exhibit improved sludge performance when a minor amount of hydrocarbon oil is included in the formulation.

5 Claims, No Drawings

POLAR OIL BASED INDUSTRIAL OILS WITH ENHANCED SLUDGE PERFORMANCE

BACKGROUND OF THE INVENTION

1. Field of the Invention

The present invention relates to polar oil, preferably ester based industrial oils of improved sludge performance.

2. Description of Related Art

U.S. Pat. No. 3,346,496 is directed to lubricating oils containing carbodimides as antioxidants. The patent states that the use of carbodiimides makes it possible to substantially improve the resistance of various types of lubricants to oxidative attack. The lubricants can be based on mineral oils or synthetic oil base stocks such as polyethers or polyether esters. The carbodiimides are also reported as being effective protective agents against corrosion and as being capable of keeping decomposition products formed during the lubricating process in solution. The patent states that the carbodiimides can be added to the lubricants in combination with diphenyl amine anti oxidants or hydroquinolines and that, surprisingly, a synergistic effect is achieved. Review of the data presented in U.S. Pat. No. 3,346,496 and the different pathways by which carbodiimides and diphenyl amines act, however, show that these statements are not correct.

The carbodiimides react with acidic molecules (carboxylic acids, inorganic acids . . . ) to give neutral products. Thus, if an oil has acidic components, adding a carbodiimide will lower the Total Acid Number (TAN) of the oil. The oxidation of mineral oils is widely understood to take place through a free radical mechanism. Some of the reaction products of this oxidation process are organic acids such as carboxylic acids. The presence of these acids, however, does not significantly promote the oxidation of the mineral oil. Another way of saying this is that the free radical oxidation of mineral oils is not acid catalyzed. Molecules that acts as antioxidants for mineral oils do so by either interrupting the free radical propagation mechanism of the oxidation process or by decomposing free radical initiators such as hydroperoxides. By doing this, they slow down the oxidative degradation of the oils.

The TAN of an oil is often used as an indication of the extent to which the oil has oxidized. Again, this is because the concentration of acidic molecules in an oil increases as the oil oxidizes and is thus an indirect measure of the extent of oxidation of the oil. The examples shown in U.S. Pat. No. 3,346,496 use the D 943 oxidation test to measure the oxidation life of the oils. This test measures the TAN of the oil. The time it takes for the TAN of the oil to reach 2.0 mg KOH/mg is deemed the oxidation life of the oil for this test. A unique situation is created when an acid scavenging molecule, such as a carbodiimide, is added to an oil. The TAN can no longer be used as a measure of the oxidation life of the oil. The oil will undergo its normal oxidation process but the acidic byproducts of oxidation are effectively removed from the oil and therefore the concentration of acid in the sample does not accurately reflect the extent of oil oxidation.

It is expected that, in a mineral oil which contains both a diphenyl-amine antioxidant and a carboddiimide acid scavenger, the oxidation life of the oil, as measure by the D 943 test, would be approximately equal to the sum of the oxidation life of the same oil with the same concentration of diphenylamine and the same mineral oil with the same concentration of carbodiimide minus the oxidation life of the mineral oil itself (so you do not count it twice). This is because the diphenylamine antioxidant would react to interfere with the oxidation process of the oil until the diphenylamine was depleted. At this point the oil would start to oxidize and produce acidic products. Once formed, these acidic products would react with the carbodiimide. The TAN of the oil would remain low until the carbodiimide was depleted. These two processes are separate events which, for the most part would happen sequentially.

Table 1 of U.S. Pat. No. 3,346,496 lists TAN data, from D 943 testing, relevant to their invention. Review of the data of U.S. Pat. No. 3,346,496 reveals that the TAN of a naphthene-based oil, with 1% of 2,6,2',6'-tetra-isopropyl-diphenyl-carbodiimide, reaches 2.0 mg KOH/mg after about 510 hours on test.

The TAN of the same naphthene-based oil, with 0.2% 4,4'-dimethylbenzyldiphenylamine, would reach 2.0 mg KOH/mg after about 350 hours on test. From Table 1 of U.S. Patent 3,346,496 it can be estimated that the naphthene-bases oil per se reached a TAN=2.0 mg KOH/mg after about 30 hours. Therefore, a formulation in the same naphthene-based oil containing 1% of 2,6,2',6'-tetra-isopropyl-diphenyl-carbodiimide and 0.2% 4,4'-dimethylbenzyl-diphenylamine would be expected to reach a TAN of 2.0 mg KOH/mg after about 830 hours on test. The data shows this exact combination to reach a TAN of 2.0 mg KOH/mg after about 915 hours on test. This gives a difference of about 85 hours between the expected lifetime and the measured lifetime. The precision statement for the D 943 test states that the repeatability of the test method is 0.192× (mean measurement value). Therefore, the measured value of 915 hours has an error of +/−176 hours. Consequently, the measured value of 915 hours is not statistically different from the expected value of about 830 hours. A synergy has only occurred when the combined effect of two or more agents is greater than the sum of the effects of each of the agents separately. Contrary to the claim, the data presented in the U.S. Pat. No. 3,346,496 shows that the combination of carbodiimide and diphenylamine are not synergistic.

EP 715079 describes a refrigerator oil comprising an ester type base oil and further containing tri cresyl phosphate and either an epoxy compound comprising glycidyl ether or a carbodiimide acid scavenger. The formulation can also contain a copper deactivator such as 5-methyl-1H benzotriazole or 1-di-octyl amino methyl benzotriazole. The EP '079 states that the hydrolysis of the polyol ester oil was suppressed and hydrolytic production of fatty acids was stabilized by the use of the carbodiimide acid scavenger.

U.S. Pat. No. 5,614,483 teaches that ester based oils containing carbodiimide are resistant to hydrolytic decomposition. At column 11 beginning at line 8, the patent goes on to state that " . . . if desired, the lubricants for use in refrigerators of the present invention may be mixed with other known refrigerator oils such as synthetic oils (e.g., alkyl benzene, poly-α-olefin, etc)." This said, the patent contains no examples to a lube formulation comprising polyol ester base and carbodiimide acid scavenger and poly alpha olefin oil or any other strictly hydrocarbon oil.

It would be advantageous if a way would be found to reduce the sludging tendency of polyol ester based individual lubricating oils.

DESCRIPTION OF THE INVENTION

It has been discovered that the sludging tendency of polar base stock oils such as ester based industrial lubricant oil containing an acid scavenger can be improved by the addition to the oil of a minor quantity of a substantially essentially hydrocarbon oil such as high saturates content mineral oil, e.g., catalytically hydrogenated oils including hydrofined, hydrotreated, hydrocracked and hydroisomerized oils, oils obtained by gas conversion (e.g., Fischer-Tropsch oils and oils obtained by the hydroisomerization of Fischer-Tropsch waxes produced from synthesis gas, or synthetic oils as exemplified by poly alpha olefin, preferably polyalpha olefin, most preferably, low viscosity PAOs.

The polar base stock oils include vegetable oils, polyalkylene glycols, poly esters, phosphate esters, alkylbenzenes, polyol esters, etc. Ester base oils useful in the present invention are well known in the industry and include dibasic acid ester, polyester, aromatic polybasic acid ester, polyol ester and the like, preferably polyol esters. For certain applications the polyol ester oils exhibiting biodegradability may be preferred. The preferred ester oil, the polyol ester oil, is made by reacting polyhydric alcohols such as those containing from 2 to 6 hydroxyl groups, with acids such as mono or di carboxylic acids containing, for example, from 2–40 carbon atoms, preferably mono carboxylic acids containing 16–36 carbon atoms, such as oleic and dioleic acid. Typical polyhydric alcohols include trimethylolpropane and pentaerythritol. Polyol ester oils of this type are well known in the literature. Other useful polyol ester oils are described in U.S. Pat. No. 5,658,863, U.S. Pat. No. 5,681,800, U.S. Pat. No. 5,767,047, and U.S. Pat. No. 4,826,633.

The acid scavenger useful in the present invention are of the mono or poly carbodiimide type, the glycidyl ether type, the epoxide type. These materials are well know in the art and will only be briefly described below.

Useful mono carbodiimides include materials of the formula $$R_1—(N=C=N)—R_2$$

wherein $R_1$ and $R_2$ are the same or different and are hydrogen, hydrocarbyl groups or nitrogen and/or oxygen containing hydrocarbyl groups. Thus $R_1$ and $R_2$ can be $C_1$–$C_{12}$ aliphatic groups, $C_6$–$C_{18}$ aromatic groups or aromatic-aliphatic groups.

Thus, $R_1$ and $R_2$ may be for example hydrogen atom, alkyl groups such as methyl, ethyl propyl, isopropyl butyl, isobutyl pentyl, 2-methylbutyl, hexyl heptyl, octyl, 2-ethylhexyl, nonyl, decyl, undecyl, dodecyl and the like, alkenyl groups such as propenyl, butenyl, isobutenyl pentenyl, 2-ethylhexenyl, octenyl and the like, cycloalkyl groups such as cyclopentyl cyclohexyl, methyl-cyclopentyl, ethylcyclopentyl and the like, aryl groups such as phenyl, naphtyl and the like, alkyl substituted aryl groups such as alkyl substituted phenyl groups for example toluyl, isopropylphenyl, diisopropylphenyl, triisopropylphenyl, nonylphennyl and the like, aralkyl groups such as benzyl, phenetyl and the like. Examples of monocarbodiimides are the following: di-isopropyl-carbodiimide, di-n-butyl-carbodiimide, methyl-tert-butyl-carbodiimide, dicyclohexyl-carbodiimide, diphenyl-carbodiimide, di-p-tolyl-carbodiimide and 4,4'-didodecyl-diphenyl-carbodiimide. Of special advantage are diphenyl-monocarbodiimides which carry on the phenyl moiety at the ortho-position to the carbodiimide group various substituent groups, e.g., alkyl, alkoxy, aryl and aralkyl radicals, such as 2,2'-diethyl-di-phenyl-carbodiimide, 2,2'-di-isopropyl-diphenyl-carbodiimide, 2,2'-diethoxy-diphenyl-carbodiimide, 2,6,2,',6'-tetra-ethyl-diphenyl-carbodiimide, 2,6,2',6'-tetraisopropyl-di-phenyl-carbodiimide, 2,6,2',6'-tetraethyl-3,3'-dichloro-di-phenyl-carbodiimide, 2,2'-diethyl-6,6'-dichloro-diphenyl-carbodiimide, 2,6,2',6'-tetra-isobutyl-3,3'-dinitro-diphenyl-carbodiimide and 2,4,6,2'4',6'-hexaisopropyl-diphenyl-carbodiimide.

Suitable polycarbodiimides are, for example, tetramethylene-ω,ω'-bis-(tert-butyl-carbodiimide), hexamethylene-ω,ω'-bis-(tert-butyl-carbodiimide), tetramethylene-ω,ω'-bis-(phenyl-carbodiimide) and those compounds which may be obtained by heating aromatic polyisocyanates such as 1,3-di-isopropyl-phenylene-2,4-di-iso-cyanate, 1-methyl-3,5-diethyl-phenylene-2,4-diisocyanate and 3,5,3',5'-tetra-isopropyl-diphenylmethane-4,4-di-isocyanate, in the presence of tertiary amines, basically reacting metal compounds, carboxylic acid metal salts or non-basic organometal compounds at a temperature of at least 120° C., according to the process of German Patent No. 1,156,401.

Glycidylether type acid scavengers are generally of the formula

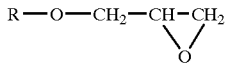

where R is an aliphatic or aromatic hydrocarbon. Glycidylether acid scavengers are well known in the literature.

Epoxides can be cyclic, acyclic, and polymeric in nature. Cyclic epoxides include the mono- and bis-cyclohexene oxides, monoepoxyethylene cyclohexanes. Acyclic epoxides include epoxidized vegetable oils, epoxidized ester (e.g., ethyl-cis-9,10-epoxy stearate and glycidyl stearate), and the aforementioned glycidyl ethers. Polyepoxy novalacs, polyglycidyl ethers, polyepoxy-cyclohexanes, and polyepoxy esters are examples of polymeric epoxides.

Typical useful epoxides are the cycloaliphatic epoxides generally of the formula:

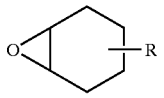

where R is a hydrocarbyl group which may contain functional groups such as esters, ethers, ketones, aldehydes, additional epoxy groups, amines, amides, imides, thiolates, etc. Other useful epoxides include epoxides exemplified by:

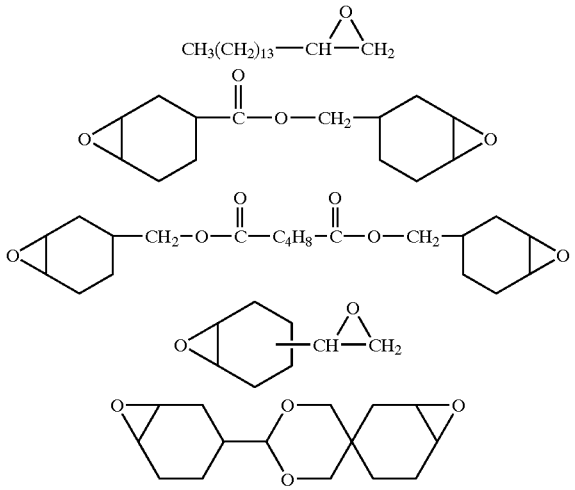

-continued

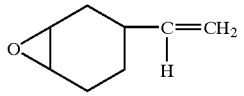

While the use of acid scavengers in ester base oils is well known and an acknowledged way to reduce hydrolysis and increase the oxidation life of ester based oils in the ASTM D943 test (measure of the time it takes for a sample to reach a total acid number of 2.0 mg KOH/g), it has been found that the presence of the acid scavenger results in a significant amount of sludge in the oil at the end of 1000 hours in the ASTM D4310 test.

The addition of a substantially essentially hydrocarbon oil to polar based oil or ester type base oil containing an acid scavenger has been found to unexpectedly improve the sludge formation resistance of such base oil. The hydrocarbon oil used is any substantially hydrocarbon oil of the paraffinic or naphthenic type, e.g., white oil or other heavily refined mineral oil, or poly alpha olefin, or Fischer-Tropsch wax isomerate oil. Among the preferred mineral oils are the catalytically hydrogenated oils, including hydrofined, hydrocracked, hydrotreated and hydroisomerized oils, such oils having a saturates content of about 92% or higher. By substantially essentially hydrocarbon oil is meant an oil of low or essentially no heteroatom content and having little polarity, an oil essentially made up of carbon and hydrogen. Preferably, the substantially hydrocarbon oil is polyalpha olefin, e.g., PAO 2-PAO 100, preferably PAO 2-PAO 40, most preferably, easily biodegradable PAO 2 (PAO 2 has a percent biodegradability of 53% as measured by the Modified Sturm Test). The particular substantially essentially hydrocarbon oil, e.g., poly alpha olefin oil used, as well as the quantity used is left to the discretion of the practitioner, as dictated by the final viscosity target of the finished lube product. Thus, when using a high viscosity polar oil base stock (e.g., ester), a light substantially essentially hydrocarbon oil will be used to produce a formulated oil of lower overall viscosity. Alternatively, if the base stock is already of the correct viscosity to produce the product a substantially essentially hydrocarbon oil of similar viscosity will be used, the hydrocarbon oil being added for the purpose of reducing the sludging of the polar oil containing the acid scavenger.

In practice, the amount of essentially hydrocarbon oil added to the polar base oil/acid scavenger combination, will be on the order of about 1 to 25 wt % hydrocarbon oil, preferably about 1 to 10 wt % hydrocarbon oil. The amount of carbodiimide type acid scavenger present will be 0.05 to 5 wt % acid scavenger, preferably 0.1 to 1.0 wt % acid scavenger. When the acid scavenger is of the glycidyl ether or epoxide type, the amount used will be in the range 0.1 to 25 wt %, preferably 1–10 wt %.

The lubricating oils for the present invention may also contain any of the other commonly used lubricating oil additives. Thus, the formulated oils can contain additional anti oxidants such as phenol and other amine type anti oxidants, viscosity and viscosity index improvers such as polyalkylene or polyolefin viscosity improver, e.g., polyisobutylene, poly(meth)acrylate viscosity index improvers metal deactivator such as triazoles and thiadiazoles, extreme pressure and anti wear additives such as phosphate esters, amine phosphates sulfurized olefins, other sulfurized and polysulfurized hydrocarbons, metal thio phosphates such as ZDDP, metal thio carbamates, anti rust agents such as carboxylic acids, dispersants such as succinimides, detergents such as metal sulfonates, phenates or carboxylates, anti foamants, etc. The amount of such other additives included in the formulation will be the amount typically and traditionally used in formulated oils, resulting in an amount in total in the range 0 to 20 wt %.

The invention is further described by reference of the following comparative examples and non-limiting examples.

EXAMPLE

Six (6) formulated oil samples were prepared (Samples A through F). The carbodiimide acid scavenger Additin RC 8500 was added to three fully biodegradable hydraulic fluid samples. All three formulations have a TAN of less than 2.0 mg KOH/g at the end of 1000 hours in the D4310 test and therefor, are considered to pass the test. AU three samples (A, B and C) contain the same additives and a major amount of polyol ester base stock oil. The polyol ester used is described in U.S. Pat. No. 5,681,800, U.S. Pat. No. 5,767,046 and U.S. Pat. No. 5,658,863. It is a neopolyol ester made from tech penta erythritol (mixture of mono-, di-, and tri-pentaerythritol) reacted with a mixture of predominantly linear $C_6$–$C_{12}$ acids and branched $C_8$ acid. The formulations differ in the nature of the minor oil component which is added to adjust down the viscosity of the fluid while maintaining good biodegradability. Sample A uses the ester di isodecyladipate (DIDA), Sample B uses polyol ester NP317 and Sample C uses PAO-2. Table 1 presents the formulation data and results. It is seen that Sample C has only 547.9 mg of sludge at the end of the test while Samples A and B have 2571.3 mg and 2979.9 mg respectively. Sample D is similar to Sample B except for the exclusion of the phenolic anti oxidant and the aminic anti oxidant. Sample D also had a high sludge content, 2548.2 mg after 1000 hours. Sample D is presented to show that neither the phenol nor aminic anti oxidants are responsible for the sludge formation.

Sample E is identical to Sample D except for the exclusion of the carbodiimide acid scavenger, Additin RC 8500. After 336 hours the sample had a TAN of 2.535 mg KOH/g and clearly failed the test but sludge formation was found to be negligible, leading to the conclusion that sludge formation is intimately linked to the presence of the acid scavenger.

Sample F is similar to Sample A, B and C but excludes the DIDA, the NP317 and the PAO of those samples. This sample was evaluated to determine whether the poor sludging tendencies of Samples A and B were due to the presence of the DIDA or NP317 or the absence of PAO 2. Sample F exhibited a sludging tendency which was very high (3516.8 mg). This strongly suggests that the low sludging tendency of Sample C was due to the presence of the PAO 2.

Analysis of the sludge from all the samples indicate that the sludge is iron oxide (rust). This suggests that the PAO acts to improve the anti rust characteristics of ester based formulations which contain acid scavenger. This being the case it can be expected that other polar base stocks would be similarly advantageously effected in respect to sludge formation by the addition of PAO.

The results are summarized in Table 1.

TABLE 1

| | Component * | Sample A | Sample B | Sample C | Sample D | Sample E | Sample F |
|---|---|---|---|---|---|---|---|
| Basestocks | Polyolester | 76.69 | 76.69 | 76.69 | 76.68 | 77.08 | 96.20 |
| | DIDA | 19.51 | | | | | |
| | NP 317 | | 19.51 | | 20.12 | 20.22 | |
| | PAO2 | | | 19.51 | | | |
| Additives | Additive Package A ** | 2.7 | 2.7 | 2.7 | 2.7 | 2.7 | 2.7 |
| | Phenolic type antioxidant | 0.30 | 0.30 | 0.30 | | | 0.30 |
| | Alkylated diphenyl amine antioxidant | 0.30 | 0.30 | 0.30 | | | 0.30 |
| | Additin RC 8500 | 0.50 | 0.50 | 0.50 | 0.50 | | 0.50 |
| | 1000 Hour Sludge TAN (mg KOH) | | | | | | |
| | 1 week (168 hour) | −0.079 | −0.077 | −0.076 | −0.036 | 0.476 | −0.154 |
| | 2 week (336 hour) | −0.038 | −0.064 | −0.076 | −0.049 | 2.535 | 0.0549 |
| | 3 week (504 hour) | −0.048 | −0.045 | −0.061 | −0.020 | | |
| | 4 week (672 hour) | 0.001 | −0.014 | −0.024 | −0.009 | | 0.0199 |
| | 5 week (840 hour) | −0.006 | −0.022 | −0.028 | 0.013 | | |
| | 6 week (1000 hour) | 0.015 | −0.039 | −0.034 | −0.005 | | 0.0657 |
| | Sludge (mg) at 1000 hr | 2571.3 | 2979.9 | 547.9 | 2548.2 | | 3516.8 |

* Quantities are in wt %.

** Additive Package A contains triazole metal deactivators, dimercaptothiadiazole metal deactivator; aryl thiophosphate, succinimide rust inhibitor, alkylated phenyl-naphthyl amine antioxidant, and a sulfurized hydrocarbyl sulfurized fatty acid ester EP agent.

What is claimed is:

1. An industrial oil of enhanced sludge resistance performance comprising: a major amount of an ester base oil; an effective amount of an acid scavenger; and from about 1 to 25 wt % of a polyalpha olefin oil.

2. The industrial oil of claim 1 wherein the acid scavenger is selected from the group consisting of carbodiimide, epoxide and glycidyl ether.

3. The industrial oil of claim 2 wherein when the acid scavenger is carbodiimide the carbodiimide is present in an amount in the range of about 0.05 to 5 wt % and when the acid scavenger is epoxide or glycidyl ether, the epoxide or glycidyl ether is present in an amount in the range of about 0.1 to 25 wt %.

4. A method for enhancing the sludge resistance performance of an industrial oil comprising a major amount of an ester base oil containing an effective amount of an acid scavenger the method comprising: adding to said oil from about 1 to 25 wt % of a polyalpha olefin oil.

5. In an industrial oil composition comprising a major amount of an ester base oil and an effective amount of an acid scavenger selected from the group consisting of carbodiimides, epoxides and glycidyl esters, the improvement comprising adding to the oil from about 1 to about 25 wt % of a polyalpha olefin oil whereby the sludge resistance of the composition is enhanced.

* * * * *